United States Patent [19]

Grözinger et al.

[11] 4,245,590

[45] Jan. 20, 1981

[54] ELECTRONIC CONTROL APPARATUS FOR A FUEL INJECTION SYSTEM IN INTERNAL COMBUSTION ENGINES

[75] Inventors: Werner Grözinger, Illingen; Friedrich Rabus, Schwieberdingen, both of Fed. Rep. of Germany

[73] Assignee: Robert Bosch GmbH, Stuttgart, Fed. Rep. of Germany

[21] Appl. No.: 9,011

[22] Filed: Feb. 2, 1979

[30] Foreign Application Priority Data

Feb. 2, 1978 [DE] Fed. Rep. of Germany ..... 2804444

[51] Int. Cl.[3] ..... F02B 3/00

[52] U.S. Cl. ..... 123/488; 123/487

[58] Field of Search ..... 123/32 EB, 32 EC, 32 ED, 123/32 EA, 117 R, 117 D; 73/35

[56] References Cited

U.S. PATENT DOCUMENTS

| | | | |
|---|---|---|---|
| 3,916,865 | 11/1975 | Kiencke et al. | 123/32 EA |
| 3,946,709 | 3/1976 | Monpetit | 123/117 D |
| 4,015,563 | 4/1977 | Drews et al. | 123/32 ED |
| 4,084,552 | 4/1978 | Drews et al. | 123/32 ED |
| 4,096,833 | 6/1978 | Sweet | 123/32 ED |
| 4,130,095 | 12/1978 | Bowler et al. | 123/32 EB |
| 4,140,087 | 2/1979 | Daumer et al. | 123/32 EC |

*Primary Examiner*—P. S. Lall

*Attorney, Agent, or Firm*—Edwin E. Greigg

[57] ABSTRACT

An electronic control apparatus for a fuel injection system in internal combustion engines which has a timing device for the generation of electric injection pulses, whose duration is dependent on operating characteristics and which are delivered to at least one electromagnetic injection valve which includes a time control circuit associated with the timing device in order to form at least one limiting value for the subsequent injection pulse and the subsequent injection pulse as well as the at least one limiting value can be delivered to a selector circuit so as to limit variations with respect to the duration of the injection signal thereby achieving smooth operation of the internal combustion engine. On the basis of an injection pulse at time tn, limiting values are formed for the duration of the subsequent injection pulse, and the next subsequent injection pulse at time tn+1 is kept within the limiting value which has been generated, it being particularly favorable to form the electronic control apparatus using digital structural elements, by means of which not only a high degree of precision and reliability but also an easy adaptation to other digital systems is obtained.

8 Claims, 9 Drawing Figures

ELECTRONIC CONTROL APPARATUS FOR A FUEL INJECTION SYSTEM IN INTERNAL COMBUSTION ENGINES

BACKGROUND OF THE INVENTION

The invention relates to an electronic control apparatus for a fuel injection system having a timing device for the generation of electrical injection pulses whose duration is dependent on operating characteristics. One such known control apparatus has an apparatus for limiting the maximum duration of injection pulses, whereby this limiting value is furnished parallel to each injection pulse.

However, when operating internal combustion engines with injection systems, it has proved to be desirable not only to fix the maximum injection duration but also, when needed, to limit the variation of the duration of injection from pulse to pulse. This continuous monitoring of the time differential in the duration of two injection pulses which occur in series is not possible in the control apparatus embodied in accordance with the prior art.

OBJECT AND SUMMARY OF THE INVENTION

The control apparatus in accordance with the invention has the advantage over the prior art in that the extent of the injection time variation between two injection pulses is susceptible to limitation to a selectable value. How great the maximum variation of the injection duration may be depends on the particular type of internal combustion engine as well as the desired amount of driving comfort.

The control apparatus of the invention lends itself to various features by means of which certain advantages are obtained. Thus, by means of the invention, a variation in the duration of injection pulses occurring in series are first limited when a certain engine temperature is reached. The values for the permissible variation in the duration of the injection signals preferably lie at the multiplicative factors of 0.75 to 1.25. Other additive limiting value formations are possible in addition to the above-mentioned multiplicative formations of limiting values, whereby the choice, additive or multiplicative, is dependent on various considerations, among them economic considerations.

The invention will be better understood as well as further objects and advantages thereof become more apparent from the ensuing detailed description of a preferred embodiment taken in conjunction with the drawings.

Figure 2:
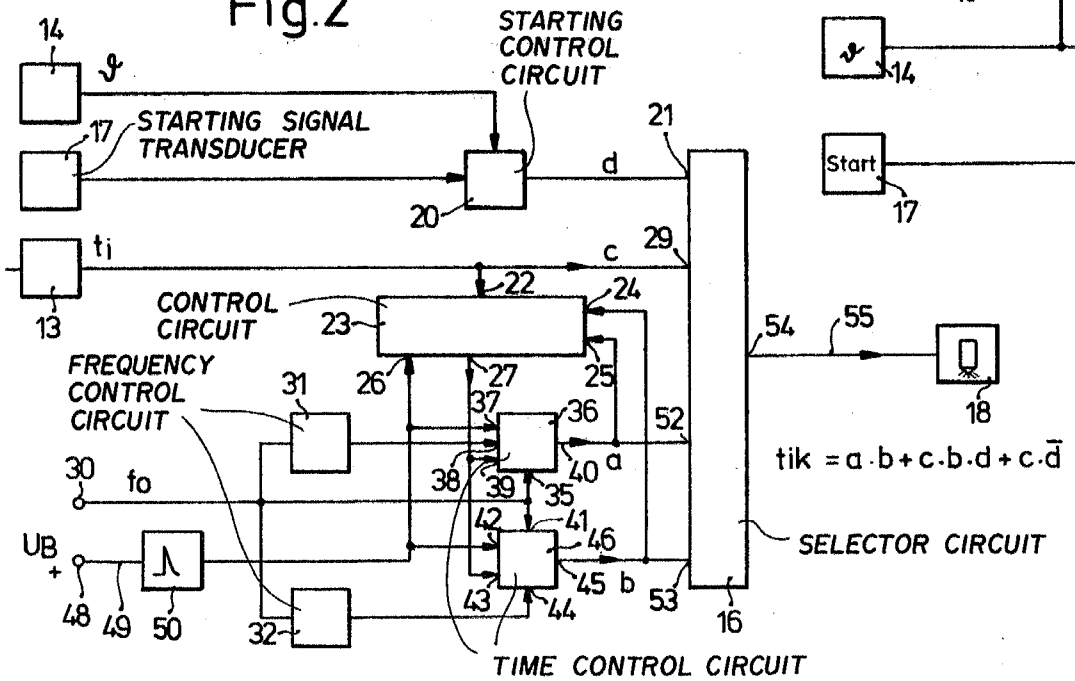
FIG. 2 is a circuit diagram in detail of the block diagram of FIG. 1 showing two time control circuits and the selector circuit.
Figure 3A:
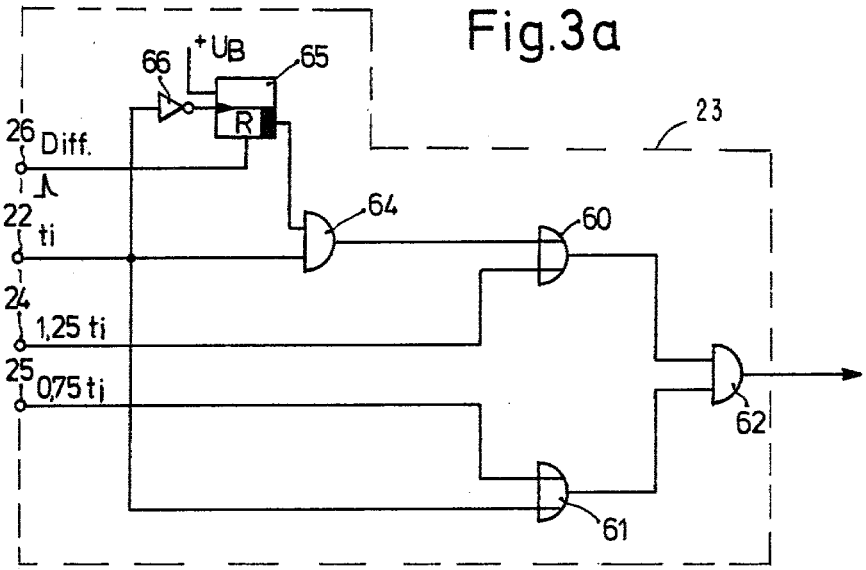
Figure 3B:
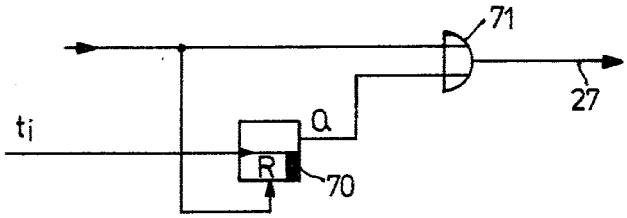

FIG. *3a* is a schematic diagram of the control circuit of FIG. 2;

FIG. *3b* is a schematic diagram of an addition to the control circuit of FIG. *3a;*

Figure 4:
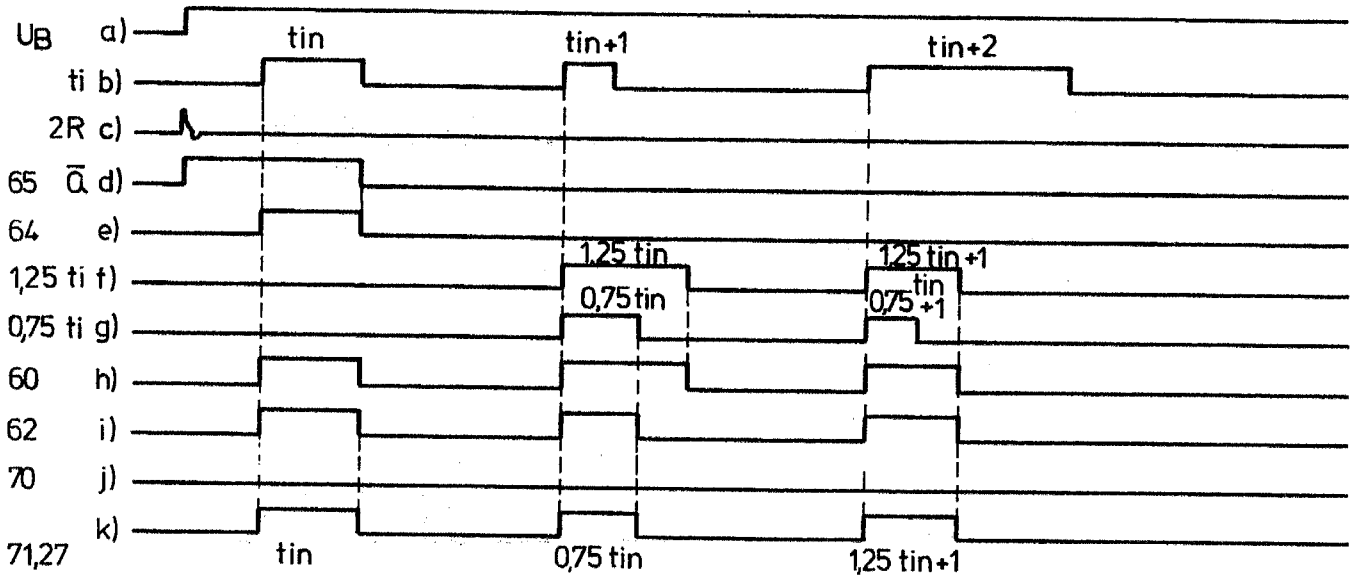

FIG. 4 is a pulse diagram for the circuits of FIGS. *3a* and *3b;*

Figure 1:
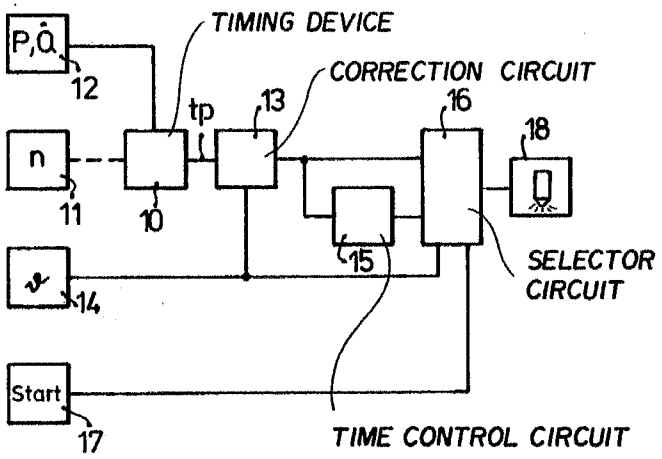
FIG. 1 is a schematic block circuit diagram of an electronic control apparatus constructed in accordance with the invention for a fuel injection system in internal combustion engines.
Figure 5:
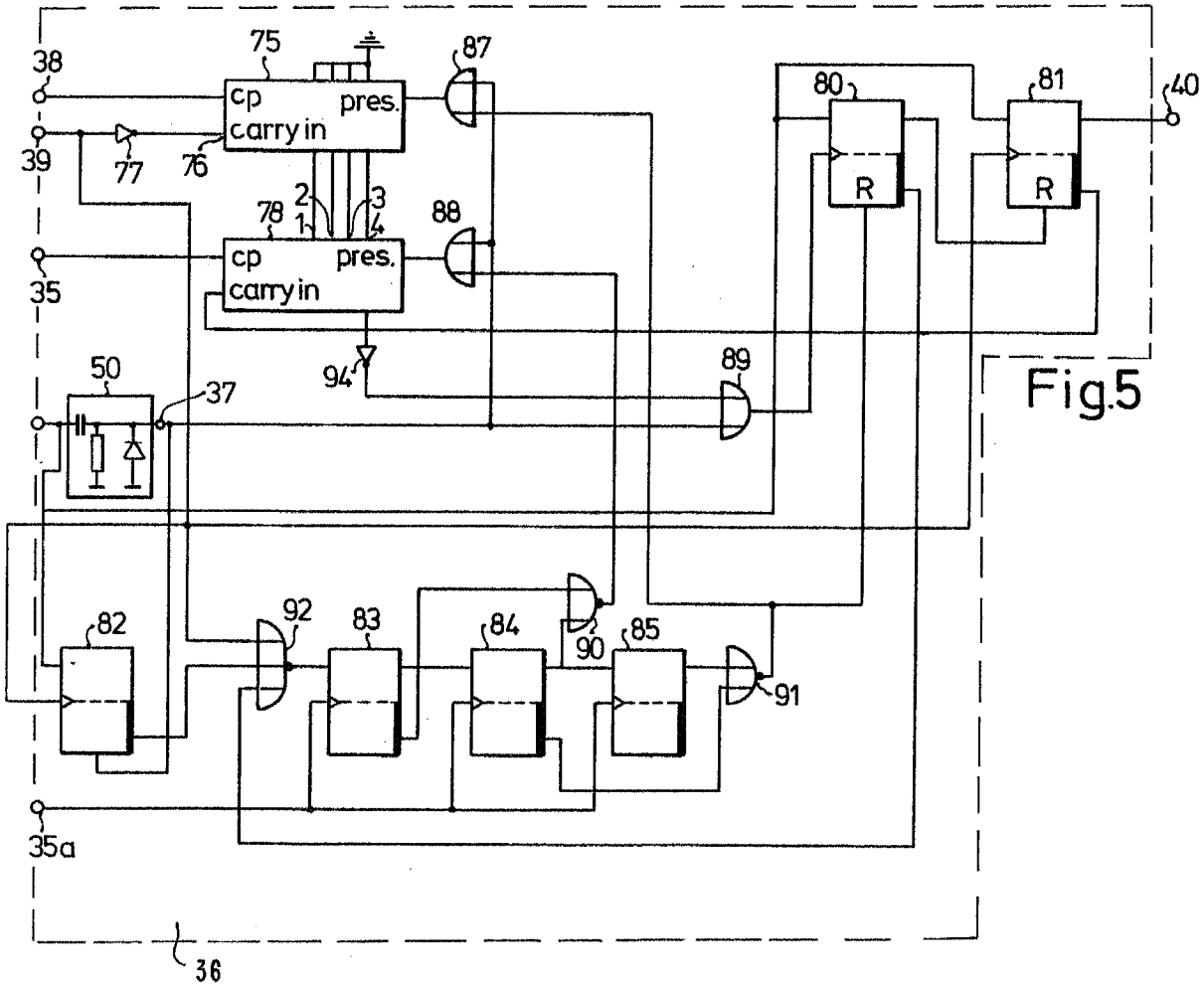
Figure 6:
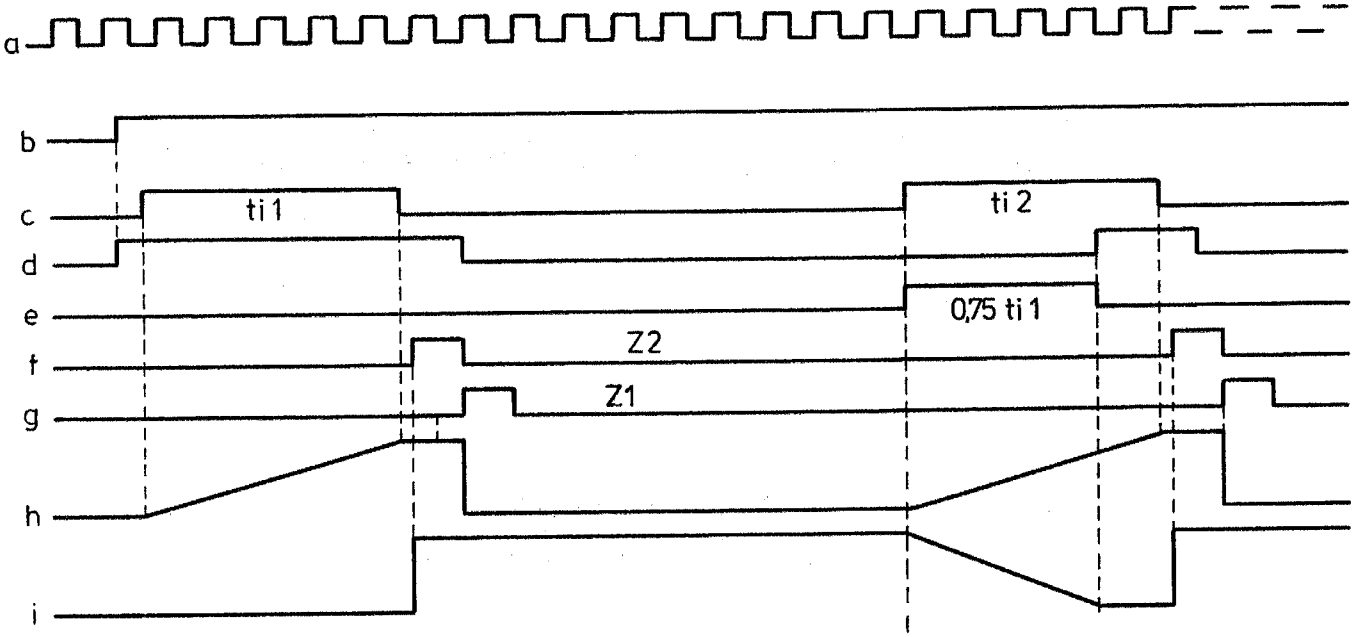
Figure 7:
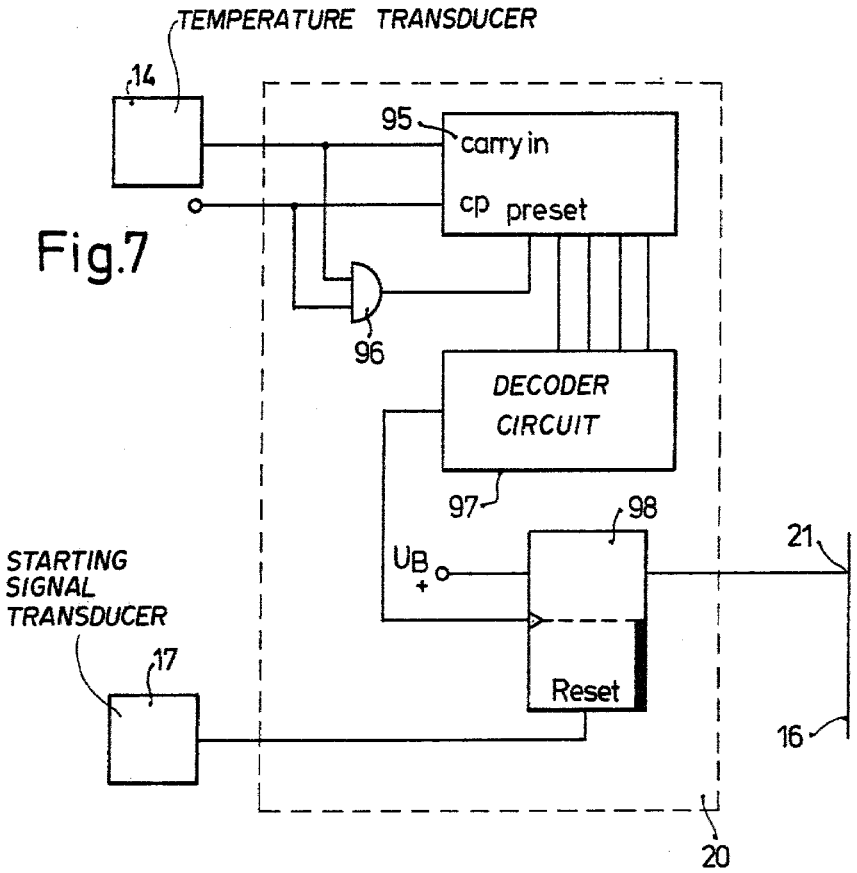
Figure 8:
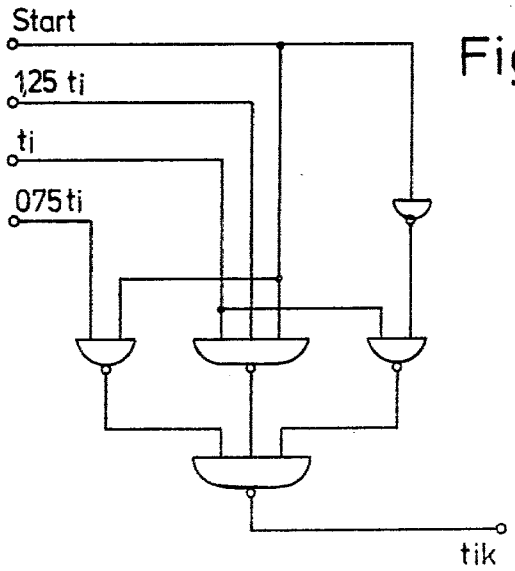

FIG. 5 is a diagram of the time control circuit in the diagrams of FIGS. 1 and 2;

FIG. 6 is a pulse diagram for the time control circuit of FIG. 5;

FIG. 7 is a schematic diagram of the starting control circuit of the invention; and FIG. 8 is a schematic diagram of a selector circuit utilized in the circuits of FIGS. 1 and 2.

DESCRIPTION OF THE PREFERRED EMBODIMENT

FIG. 1 shows a schematic block circuit diagram of an electronic control apparatus for a fuel injection system utilized in internal combustion engines. A timing device 10 determines, on the basis of signals from an rpm transducer 11 and a pressure sensor 12, an injection time tp, which is corrected in a subsequent correction circuit 13 in accordance with the output signal of a temperature transducer 14. The correction circuit 13 is followed by a time control circuit 15 as well as a selector circuit 16, and this selector circuit 16 receives output signals of the time control circuit 15, the temperature transducer 14, and a starting signal transducer 17. The output of the selector circuit 16 is connected, via a driver circuit (not shown), to an electromagnetic injection valve 18. In the time control circuit 15, a limiting value for the duration of a subsequent injection pulse is provided and the selector circuit 16 limits the duration of the subsequent injection pulse to the minimum and/or maximum value corresponding to the output signal of the time control circuit 15 and in dependence on the signals of the temperature transducer 14 and the starting signal transducer 17.

A more detailed block circuit diagram of the control apparatus of FIG. 1 is shown in FIG. 2. The output signals of the temperature transducer 14 and the starting signal transducer 17 are fed to a starting control circuit 20, whose output is coupled to a first input 21 of the selector circuit. One output of the correction circuit 13 for the injection signal is connected first with a first input 22 of a control circuit 23, having three further inputs 24, 25, 26 and an output 27. The output of the correction circuit 13 is further connected with a second input 29 of the selector circuit 16.

A signal of constant frequency fo is present at a terminal 30 and this terminal 30 is fed to two frequency control circuits 31 and 32, whose output signals are 0.75 and 1.25 times the input signals, respectively. Furthermore, the terminal 30 is connected with the inputs 35 and 41 of two time control circuits 36 and 46, respectively. These time control circuits 36 and 46 are connected at their inputs 39 and 43, respectively, with the output 27 of the control circuit 23. Furthermore, the frequency control circuits 31 and 32 are connected to the inputs 38 and 44 of the time control circuits 36 and 46, respectively.

A line 49 leads from an operating voltage ($+U_B$) source 48 on line 49 to a differentiation device 50, whose output is coupled to the input 26 of the control circuit 23 and with the inputs 37 and 42 of the time control circuits 36 and 46, respectively. The outputs 40 and 45 of the time control circuits 36 and 46 are first fed back to the inputs 24 and 25 of the control circuit 23 and are additionally coupled with two inputs 52 and 53, respectively, of the selector circuit 16. Finally, a line 55 leads from the output 54 of the selector circuit 16 through a driver circuit (not shown) to an injection valve 18.

The starting control circuit 20 determines at which time the selector circuit 16 can assume its actual function, since below a certain engine temperature no limitation of the variation of injection pulse duration should be undertaken.

The two frequency control circuits 31 and 32 furnish output signals of differing frequency, whereby the given factors determine the highest permissible value at a particular time for a subsequent injection duration as compared with the previous injection duration. These differing frequencies are converted in the time control circuits 36 and 46 into corresponding time intervals with respect to the previous injection pulse and are available to the selector circuit 16 for the purpose of limiting value formation.

At the time tn, the corrected injection pulse ti arrives at the input 29 of the selector circuit 16 and at the input 22 of the control circuit 23. By means of the two time control circuits 36 and 46, at the time tn+1, two pulses of length 0.75 times ti and length 1.25 times ti (ti at the time tn) are generated. These two pulses are compared at the time tn+1 with the new injection signal ti at the time tn+1, and the selector circuit 16 then furnishes an injection signal, the length of which lies between 0.75 and 1.25 times the previous injection pulse. A injection signal generated in the correction circuit 13 with a duration greater than 1.25 times the previous injection signal, or a duration less than 0.75 times the previous injection signal, is suppressed, so that the duration of the injection signal at the electromagnetic injection valves 18 can undergo only a precisely settable maximum variation.

Details of the circuit arrangement of FIG. 2 are further illustrated in the remaining figures.

FIGS. *3a* and *3b* illustrate the control circuit 23 of FIG. 2, where FIG. *3b* represents an addition to the circuit of FIG. *3a*, in order to furnish the output signals precisely at the beginning of the ti signal as well. The control circuit 23 of FIG. *3a* has three inputs 22, 24 and 25 for differing pulse durations. At input 22 the corrected injection signal of length ti appears; at input 24 a pulse of length 1.25 times ti, generated in the time control circuit 46, appears; and at input 25 a pulse of duration 0.75 times ti appears. A trigger signal proceeds from a further input 26 to the control circuit 23 which marks the switch-on instant for the entire control apparatus.

Two OR gates 60 and 61 are elements included in the control circuit 23 and the outputs of the OR gates 60, 61 are fed to an AND gate 62. One input of each of the OR gates 60 and 61 is coupled with one each of the inputs 24 and 25 for the limiting values for the injection duration. While the second input of the OR gate 61 is directly connected with the input 22, the second input of the OR gate 60 is connected to the output of an AND gate 64, whose first input has a connection with the input 22 of the control circuit 23. The second input AND gate 64 is connected to the $\overline{Q}$ output of a D-type flip-flop 65. The reset input R of this flip-flop 65 is connected with the input 26 of the control circuit 23. At the D-input of this flip-flop 65, the operational voltage $+U_B$ is continuously present and the trigger input is indirectly coupled through an inverter 66 to the input 22.

The additional circuitry of FIG. *3b* contains a D-type flop-flop 70, at whose trigger input the injection signal ti is present and whose Q output is coupled to the first input of an OR gate 71. The second input of the OR gate 71 as well as the reset input of the flip-flop 70 are connected with the output of the AND gate 62 of FIG. *3a*.

The mode of operation of the circuit arrangements of FIGS. *3a* and *3b* will now be explained with reference to FIG. 4.

In FIG. 4, line (a) illustrates, at the rising edge of the signal, the switch-on initiation of the electronic control apparatus for a fuel injection system. Line (b) shows the injection pulses tin, tin+1 and tin+2, which occur one after the other. Line (c) shows the output signal of the differentiation circuit 50, and it shows an impulse at the switch-on instant of the control apparatus. Line (d) shows the output signal of the flip-flop 65 at the $\overline{Q}$ output. Because of the trigger pulse from the input 26 and the positive voltage at the D-input, a positive pulse is obtained at the $\overline{Q}$ output when the trigger edge appears at the reset input R of the flip-flop 65. The potential at the output of the flip-flop 65 switches over with a positive trigger edge, which occurs in the switching means of this flip-flop 65 when the next subsequent injection pulse ti terminates. Connected to this trailing edge, the output potentials at the flip-flop 65 remain constant, because a positive signal is continuously present at the D-input and no further reset signal appears from the input 26.

Line (e) shows the output signal of the AND gate 64, which emits only one pulse of length tin after each switch-on of the control apparatus, because subsequent to the output value of the $\overline{Q}$ output of the flip-flop 65, there is no further return to a high potential.

The time control circuits 36 and 46 each furnish a signal of length 0.75 times tin and 1.25 times tin, as is shown by the lines (f) and (g) from the inputs 24 and 25 of the control circuit 23 at the time tin+1.

Line (h) shows the output signal of the OR gate 60. It may be seen here that at the time tn, a pulse of length ti is passed through the OR gate 60 and subsequently only further pulses having a pulse duration of 1.25 times the value of the previous pulse are passed through. The output signal of the OR gate 61 has the greatest value at that time for the duration of the injection signal at time tin+1 and the value of 0.75 times the pulse duration at the time tin.

Line (i) shows the output signal of the AND gate 62 and one recognizes that here a value for the injection duration is present at a particular time which is limited to no less than 0.75 times and no more than 1.25 times the value of the preceding injection duration.

Line (j) shows the output signal of the D-type flip-flop 70 of FIG. *3b*, which only appears as a result of sharp spikes at the time of the rising edge of the ti pulse. By means of the OR connection 71, the same pulse mode is produced in line (4k) as in line (4i), except the circuit arrangement of FIG. *3b* assures that the rising edge of the pulses according to line (k) appear without fail.

One possibility for providing the time control circuits 36 and 46 is shown in FIG. 5. The two time control circuits 36 and 46 do not differ in their design, but only in the frequency of a switching signal. More specifically, the design of the time control circuit 36 is as follows:

The counting input of a first counter 75 is coupled with the input 38, and the enabling input 76 of the counter 75 is connected through an inverter 77 with the input 39. A second counter 78 can assume the counter state of the first counter 75 and can count out with the frequency which is present at the input 35. There are also six D-type flip-flops 80 through 85, three simple OR gates 87 to 89, two NOR gates 90 and 91, and a three-input NOR gate 92. The outputs of the OR gates 87 and 88 are present at the preset inputs of the counters 75 and 78. One input of each of these OR gates 87 and 88 is connected with the input 37 and the second input of the OR gate 87 is connected to the output of the NOR gate 91, while the second input of the OR gate 88 is connected to the output of the NOR gate 90.

The input 39 is connected with the trigger input of the D-type flip-flop 90.

The input 39 is connected with the trigger input of the D-type flip-flops 81 and 82 as well as with a first input of the NOR gate 92. The supply voltage is present at the D-inputs of the D-type flip-flops 80 to 82. The flip-flop 82 is reset by a signal from the input point 37. The trigger inputs of the D-type flip-flops 83 to 85 are connected with a basic clock input 35*a*. The $\overline{Q}$ output of the flip-flop 82 is fed to a further input of the NOR gate 92, whose output is connected with the D-input of the flip-flop 83. While the Q output of the flip-flop 83 is fed to the D-input of the flip-flop 84, its $\overline{Q}$ output emits a signal to the NOR gate 90, whose second input is connected with the Q output of the flip-flop 84.

Simultaneously, there is a conductive connection between the Q output of the flip-flop 84 and the D-input of the flip-flop 85, whose Q output is then conveyed to an input of the NOR gate 91. The second input of this NOR gate 91 is coupled with the $\overline{Q}$ output of the flip-flop 84. The output of the NOR gate 91 is coupled to the reset input R of the D-type flip-flop 8. The output of the NOR gate 91 is coupled to the reset input R of the D-type flip-flop 80 as well as to the OR gate 87. The $\overline{Q}$ output of the D-type flip-flop 80 is connected with the third input of the NOR gate 92, while its Q output is fed to the reset input R of the D-type flip-flop 81.

The flip-flop 80 obtains the trigger pulse from the OR gate 89, whose first input is connected through an inverter 94 with the carry output of the counter 78 and whose second input is connected with the input 37 of the time control circuit 36. While the Q output of the D-type flip-flop 81 forms the output 40 of the time control circuit 36, the signal of the $\overline{Q}$ output of this flip-flop 81 is conveyed back to the enabling input of the counter 78.

The mode of operation of the time control circuit 36 shown in FIG. 5 is as follows:

When the battery voltage is switched on, a positive spike pulse appears at the output of the differentiation circuit 50. This pulse sets the two counters 75 and 78 to zero through the present inputs. The Q output of the D-type flip-flop 80 takes a positive value, whereby the subsequent flip-flop 81 is held through the reset input R to zero potential at the Q output. The signal from the $\overline{Q}$ output of the flip-flop 81 blocks the enabling input of the counter 78.

If a positive pulse is now present at the input 39, then its positive edge sets the $\overline{Q}$ output of the D-type flip-flop 82 to zero. The flip-flop 81 cannot yet be set at the first pulse, because it is held to zero potential through the reset input R. The input pulse represents a gate time for the counter 75; it counts to HIGH with the frequency applied at the counter input (0.75 times fo or 1.25 times fo). With the termination of the input pulse, the counter state is taken over from the first counter 75 into the second counter 78 and is there stored. This takeover takes place through the preset control means, comprising the D-type flip-flops 82, 83, 84 and 85, and the logic gates 92, 95 and 96. After the takeover, the counter 75 is again set to zero, as is the $\overline{Q}$ output of the D-type flip-flop 80 through the reset input R. The preset pulses for the counters 75 and 78 have a pulse duration equivalent to the duration of the period of the basic cycle.

A new pulse at the input 39 can now set the Q output of the flip-flop 81 to high potential by means of the positive edge of the pulse at input 39, since the reset input R of the flip-flop 81 is now at zero. The counter 75 counts to HIGH over the new pulse length; and parallel to it, the counter 78, since the counter input of counter 78 has now been opened up through the $\overline{Q}$ output of the flip-flop 81, counts from its storage stage downward to zero with the frequency fo. When the counter state is zero, a pulse appears at the carry out which sets the Q output of the flip-flop 80 to HIGH and thus sets the Q output of the flip-flop 81 to zero through the reset input R. The pulse length at the Q output of the D-type flip-flop 81 is therefore proportional to the counter state of the second counter 78 and to the frequency fo.

The events described above are illustrated in the pulse diagram of FIG. 6.

In FIG. 6, line a shows the counter signal at the input 38 and thus at the counter input of the first counter 75; line b shows the course of the supply voltage in the time control circuit 36; line c shows the signal at the input 39 of the time control circuit with two injection signals; line d shows the signal at the Q output of the D-type flip-flop 80; line e shows the output signal at the Q output of the flip-flop 81; line f shows the output signal of the NOR gate 90; and line g shows the output signal of the NOR gate 91. The counter state of the first counter 75 is shown in line h and the counter state of the second counter 78 in line i.

FIG. 7 shows the starting control circuit 20, which receives input signals from a temperature sensor 14 and from a starting signal transducer 17. The output of the starting control circuit 20 is connected with the input 21 of the selector circuit 16. The most important component of the starting control circuit 20 is a counter 95, at whose enabling input (carry in) a temperature-dependent frequency is present and to whose cp input a basic clock signal is fed. Both inputs of the counter 95 are additionally conveyed to an AND gate 96, whose output is coupled with the reset input of the counter 95.

A decoder circuit 97 is coupled to the counter state output of the counter 95, and the output of the decoder circuit 97 is conveyed to the trigger input of a D-type flip-flop 98. The reset input of this flip-flop 98 is connected with the starting signal transducer 17 and the operational voltage is continuously present at the D-input. The Q output of the D-type flip-flop 98, which is coupled to the input 21 of the selector circuit 16, comprises the output of the starting control circuit 20.

The proposed electronic control apparatus is intended to initiate a limitation of the variation in injection pulse duration only after a certain coolant temperature has been attained. The circuit shown in FIG. 7 emits a positive signal at its output beyond this temperature. The temperature sensor or transducer 14 contains an NTC resistor and detects the coolant temperature. A VCO circuit converts the voltage of the NTC resistor to a temperature-dependent frequency which is then presented to the enabling input of the counter 95 in the starting control circuit 20.

Each pulse of the VCO represents a gate time for the counter 95. It counts to HIGH with the basic clock frequency and is again set to zero at the end of the VCO pulse. Since the counter state is proportional to the coolant temperature, a certain temperature may be selected with the decoder circuit 97. If this temperature is attained, a D-type flip-flop 98 is set with the pulse at the output of the decoder circuit 97. This flip-flop 98 is set back each time at the starting of the vehicle through the starting signal transducer 17.

An example of the selector circuit 16 is shown in FIG. 8. The object of this selector circuit 16 is to allow injection pulses to pass only within the given limits, while simultaneously considering the starting procedure. For this reason, it is provided that the output signal of the selector circuit 16 follows the logical equation $ti_k = a \cdot b + c \cdot b \cdot d + c \cdot \bar{d}$ (for the letter symbols, see FIG. 2). As a result of this required sequence, a simple arrangement of logic gates is produced, as is shown in FIG. 8.

The circuit arrangement described above may be designated as an anti-bounce circuit, because it prevents a sudden variation of the torque transfer of the internal combustion engine. The circuit arrangement is accomplished by digital techniques, which has the advantage that the circuit may easily be integrated with an existing digital injection system. This may be accomplished by designing the anti-bounce circuit engagement with a discrete IC, or the anti-bounce circuit arrangement may be included in the programming of a microcomputer.

The foregoing relates to a preferred embodiment of the invention, it being understood that other embodiments and variants thereof are possible within the spirit and scope of the invention, the latter being defined by the appended claims.

What is claimed and desired to be secured by Letters Patent of the United States is:

1. An electronic control apparatus for a fuel injection system in internal combustion engines comprising a timing device for generating electrical injection pulses the duration of which is dependent on operating characteristics and which are delivered to at least one electromagnetic injection valve, a time control circuit operatively responsive to the timing device for forming a signal indicative of at least one limiting value for a subsequent injection pulse, a selector circuit responsive to said time control circuit and said timing device and means for feeding said subsequent injection pulse and said at least one limiting value signal to said selector circuit.

2. A control apparatus in accordance with claim 1, wherein said limiting value signal is formed by the addition of a predeterminable time interval to the duration of an injection pulse.

3. A control apparatus in accordance with claim 1, wherein said limiting value signal is formed by a multiplication of the duration of an injection pulse with a selectable factor.

4. A control apparatus in accordance with claim 1, wherein two of said limiting value signals are provided for the purpose of forming a maximum and a minimum limiting value.

5. A control apparatus in accordance with claim 1, wherein said time control circuit includes a first and a second counter, said first counter being arranged to count out an injection pulse with a selectable frequency corresponding to the desired limit, means for transferring the final value of the injection pulse count from said first counter into the second counter, said second counter being arranged to count out said final value with a similarly selectable frequency.

6. A control apparatus in accordance with claim 1, wherein said selector circuit includes a plurality of logic gates and wherein said selector circuit is adapted to limit a subsequent injection pulse to a limiting value in accordance with the duration of the preceding injection pulse.

7. A control apparatus in accordance with claim 1, including means for discontinuing the formation of said limiting values during one of the starting phases of the engine and at a selectable internal combustion engine temperature.

8. A control apparatus in accordance with claim 1, including a control circuit connected to said time control circuit, said control circuit being adapted to furnish a secure trigger pulse at the beginning of each injection pulse, said control circuit comprising a D-type flip-flop having a D-input lying at constant potential and a subsequent OR gate.

* * * * *